United States Patent [19]

Andrews

[11] Patent Number: 4,837,839

[45] Date of Patent: Jun. 6, 1989

[54] COMPACT SPEAKER ASSEMBLY WITH IMPROVED LOW FREQUENCY RESPONSE

[75] Inventor: Jay E. S. Andrews, Glendale, Ariz.

[73] Assignee: AVM Hess, Inc., Phoenix, Ariz.

[21] Appl. No.: 84,675

[22] Filed: Aug. 11, 1987

[51] Int. Cl.[4] ..... H04R 1/24; H04R 7/12

[52] U.S. Cl. ..... 381/199; 381/158; 381/186; 381/188; 381/194; 181/146; 181/157; 181/165

[58] Field of Search ..... 181/144, 146, 147, 157, 181/163, 165; 381/182, 184, 185, 186, 188, 194, 195, 196, 197, 199, 202, 204, 205, 153, 158

[56] References Cited

U.S. PATENT DOCUMENTS

| | | | |
|---|---|---|---|
| 1,743,194 | 1/1930 | Deane . | |
| 2,426,948 | 9/1947 | Preston | 179/109 |
| 2,496,589 | 2/1950 | Marquis | 179/116 |
| 3,201,529 | 8/1965 | Surh | 179/115.5 |
| 3,213,209 | 10/1965 | Dollitzsch | 179/115.5 |
| 3,796,839 | 3/1974 | Torn | 179/116 |
| 4,401,857 | 8/1983 | Morikawa | 179/110 A |
| 4,477,699 | 10/1984 | Wada et al. | 381/202 |
| 4,554,414 | 11/1985 | House | 179/115.5 |
| 4,567,327 | 1/1986 | Goossens et al. | 381/185 |
| 4,595,801 | 6/1986 | Coffin | 179/115.5 |

FOREIGN PATENT DOCUMENTS

| | | | |
|---|---|---|---|
| 56-161796 | 12/1981 | Japan | 381/199 |

*Primary Examiner*—John W. Caldwell, Sr.
*Assistant Examiner*—Tyrone Queen
*Attorney, Agent, or Firm*—Charles E. Cates; James H. Phillips; Richard G. Harrer

[57] ABSTRACT

A speaker transducer assembly is disclosed which includes first and second speaker diaphragms supported on a frame in over and under juxtaposition. Each of the speaker diaphragms has a central opening defining an inner periphery which is attached to a voice coil form for coaxial movement therewith and in unison. An intermediate baffle is coaxially positioned between the speaker diaphragms to define upper and lower, separately vented chambers. The upper chamber is vented through an outlet in the region of the outer peripheries of the first speaker diaphragm and the intermediate baffle; similarly, the lower chamber is vented through an outlet situated in the region of the outer peripheries of the second speaker diaphragm and the intermediate baffle. Preferably, the two vent systems have different vent exhaust areas to obtain stagger tuning and thus achieve a split of the deepest frequency load. A supplementary speaker subsystem for handling the higher frequencies is positioned centrally above the upper speaker diaphragm. An aperture is provided through the magnet system for accommodating the speaker leads to the supplementary speaker subsystem. An outwardly flared upper baffle may be positioned between the first speaker diaphragm and the supplementary speaker subsystem to shield its lower face from the sound pressure waves generated by the first speaker diaphragm.

10 Claims, 2 Drawing Sheets

COMPACT SPEAKER ASSEMBLY WITH IMPROVED LOW FREQUENCY RESPONSE

FIELD OF THE INVENTION

This invention relates to the acoustical transducer art and, more particularly, to an improved speaker assembly exhibiting extended low frequency response capability for its physical size.

BACKGROUND OF THE INVENTION

As is notoriously well known in the art, compact speaker assemblies are generally deficient in their ability to provide extended low frequency response at the power and low distortion levels required for high quality reproduction. In the past, this drawback has been remedied or limited by the use of elaborate enclosures, very heavy magnet structures and other well-known, but expensive, conventional techniques or simply by the use of a larger speaker assembly properly baffled. While the latter approach is effective in environments which can accommodate larger speaker enclosures, such as in a room where there is no objection to the size of the enclosure, the former approach has been only partially successful. Consider, for example, a listening environment which demands the use of small speaker assemblies; i.e., the interior of a vehicle. For practical installations, the size of the speaker assemblies which may be emplaced in a vehicle is decidedly limited and, as a result, the most widely used "large" speaker assembly employed in the rear decks of vehicles has been the 6"×9" standard. Even the best of these speaker assemblies, usually mounted as infinite baffles, have not been able to deliver the magnificent bass avidly sought by audiophiles. Similarly, in other environments, such as a home, in which, for one reason or another, a large speaker enclosure cannot be accommodated or will not be tolerated, the same problem exists.

Thus, those skilled in the art will appreciate that it would be highly desirable to provide a speaker assembly which is compact and yet can deliver audiophile quality low frequency and full range reproduction at high intensity levels with low distortion, and it is to these ends that this invention is directed.

OBJECTS OF THE INVENTION

It is therefore a broad object of this invention to provide an improved speaker assembly.

It is a more specific object of this invention to provide an improved speaker assembly which is very compact, yet is capable of delivering high intensity, low frequency sound at low distortion levels.

It is a similar object of this invention to provide such a speaker assembly which is sufficiently compact as to fit standard speaker cut-outs provided in vehicles.

It is yet another object of this invention to provide such a speaker system which may optionally incorporate a supplementary speaker transducer subsystem to achieve smooth, full range sound reproduction.

SUMMARY OF THE INVENTION

Briefly, these and other objects of the invention are achieved with a speaker transducer assembly which includes a magnet system having a circular air gap, a cylindrical voice coil form having a voice coil wound near one end which extends into the air gap and first and second speaker diaphragms supported on a frame in over and under juxtaposition. Each of the speaker diaphragms has a central opening defining an inner periphery which is attached to the voice coil form for coaxial movement therewith and in unison. Preferably, an intermediate baffle is coaxially positioned between the first and second speaker diaphragms such that the lower side of the upper speaker diaphragm and the upper side of the lower speaker diaphragm can be separately vented. Thus, an upper chamber is vented through a vent system having an outlet in the region of the outer peripheries of the first speaker diaphragm and the intermediate baffle. Similarly, a lower chamber is vented through a second vent system having an outlet situated in the region of the outer peripheries of the second speaker diaphragm and the intermediate baffle. For an exemplary elliptically shaped speaker transducer assembly having two narrow ends and two broad sides, the outlet of the first vent system is preferably situated across the two narrow ends whereas the outlet of the second vent system is situated along both the two narrow ends and along the two broad sides. As a result, the two speaker diaphragms, having different vent exhaust areas, are differently loaded and therefore stagger tuned to achieve a split of the deepest frequency load. To obtain a full range speaker transducer assembly, a supplementary speaker transducer subsystem for handling the higher frequencies is positioned generally centrally and spaced above the upper speaker diaphragm. Preferably, a central aperture is provided through the magnet system for accommodating the speaker leads to the supplementary speaker transducer subsystem. As a further refinement, an outwardly flared upper baffle may be positioned between the first speaker diaphragm and the supplementary speaker transducer subsystem to shield the lower face of the supplementary speaker transducer subsystem from the sound pressure waves generated by the first speaker diaphragm.

DESCRIPTION OF THE DRAWINGS

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE INVENTION

Figure 1:
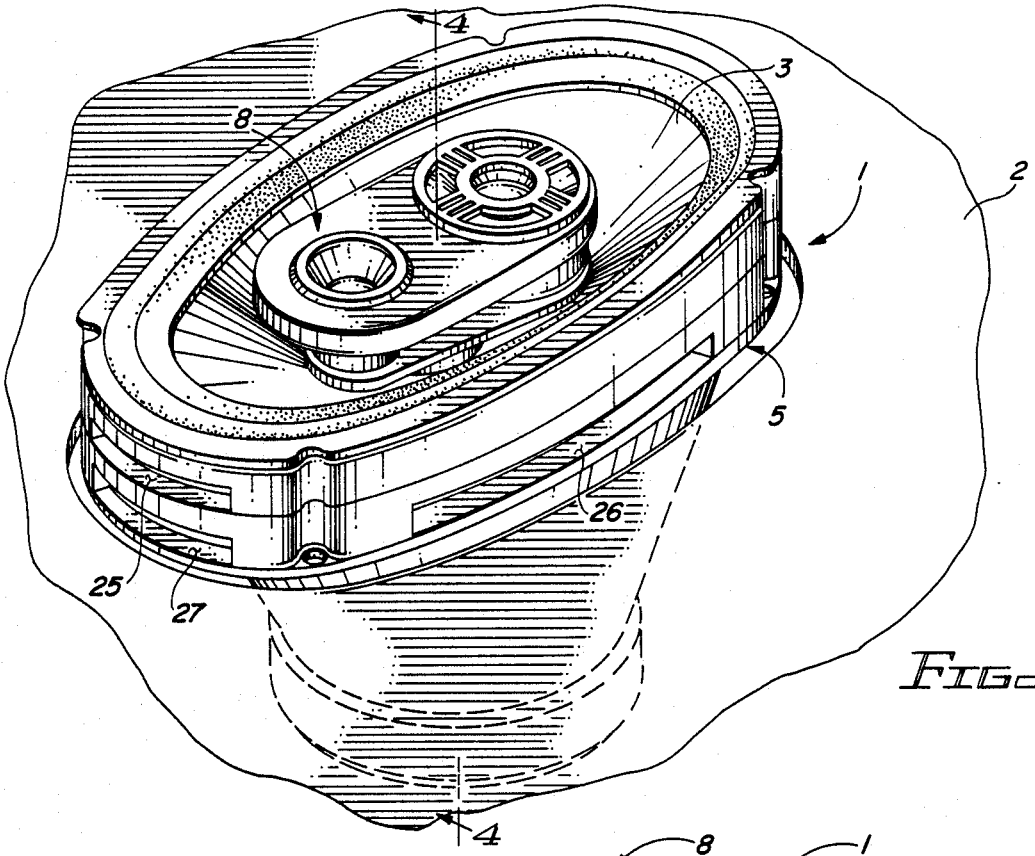
FIG. 1 is a perspective view illustrating an exemplary embodiment of the invention emplaced in an infinite baffle environment.
Figure 2:
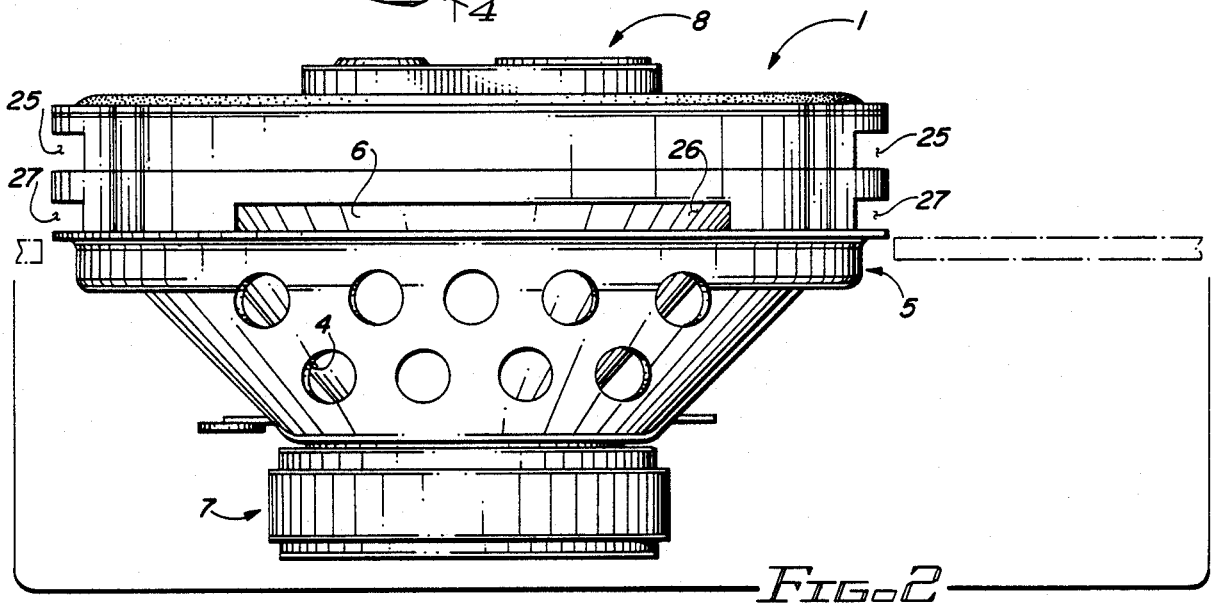
FIG. 2 is a side view of the exemplary embodiment.
Figure 3:
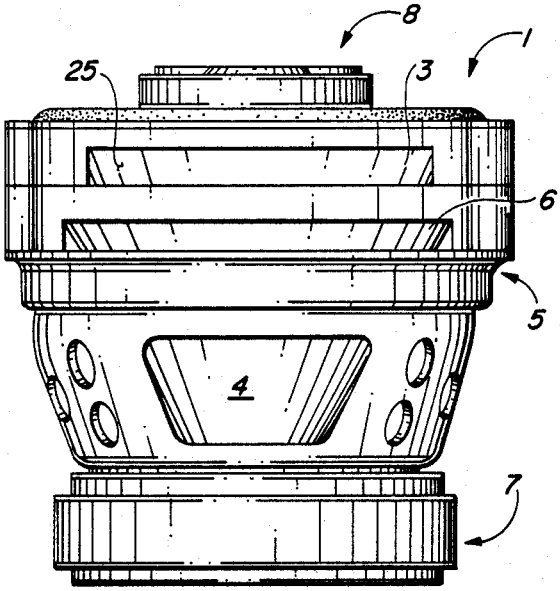
FIG. 3 is an end view thereof.

Referring now to FIGS. 1, 2 and 3, there is shown an exemplary speaker assembly 1 according to the present invention. In the illustrative example, the speaker assembly 1 is generally elliptical in shape and may, merely by way of example, have dimensions which are described in the industry as 4"×6". This particular size is commonly found in compact speaker systems and, particularly, is often employed in vehicle installations which typically are provided with ready made openings for accepting 4"×6" elliptical speakers Thus, in FIG. 1, the supporting structure 2 to which the speaker assembly 1 is mounted may simply be the rear deck of a vehicle. It will be clearly understood, however, by those skilled in the art that the subject speaker assembly 1 is not limited to such an application.

As will become more apparent from the detailed discussion of FIG. 4 below, a fundamental feature of the speaker assembly 1 is that it is provided with juxtaposed first and second speaker diaphragms 3, 4. In the illustrative embodiment, the diaphragms are conically shaped, but planar diaphragms are also contemplated. The speaker diaphragms 3, 4 are supported from a frame 5 in over and under relationship and are coaxially aligned with one another. As will become more apparent below, the inner peripheries of the speaker diaphragms 3, 4 move in unison since each is attached to a common cylindrical voice coil form which is coaxially aligned with the speaker diaphragms 3, 4. As will also be further discussed below, the lower surface of the first speaker diaphragm 3 is isolated from the upper surface from the second speaker diaphragm 4 by an intermediate baffle 6.

A conventional magnet system 7 is situated at the bottom of the frame 5 to provide electromagnetic suspension of the driving system for the speaker cones 3, 4. For a full range speaker assembly 1, a supplementary speaker transducer subsystem 8 having one or more additional speaker diaphragms is positioned generally centrally of the frame 5 and spaced above the first speaker diaphragm 3. As is well known in the art, the supplementary speaker transducer subsystem 8 may include one or more high frequency transducers and also may include a transducer for handling some or all the midrange frequencies. Typically, the supplementary speaker transducer subsystem 8 also includes a crossover network if the entire speaker assembly 1 is to be driven from a single amplifier.

Figure 5:
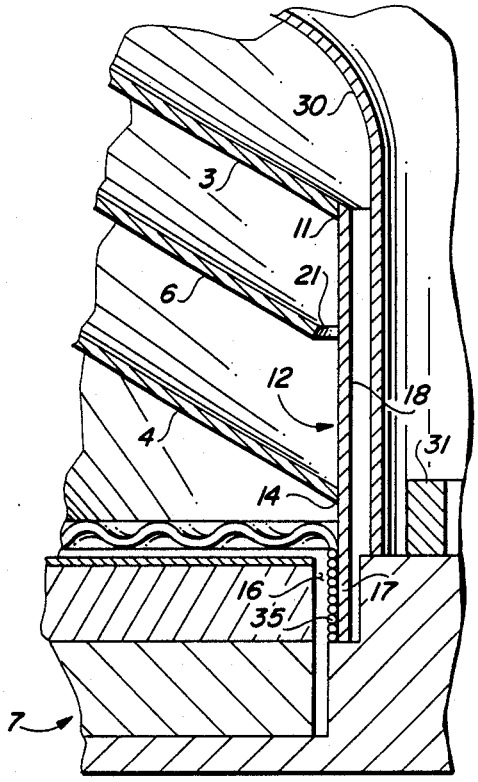
FIG. 5 is an enlarged partial view illustrating the relationship of certain structure shown in less detail in FIG. 4.
Figure 4:
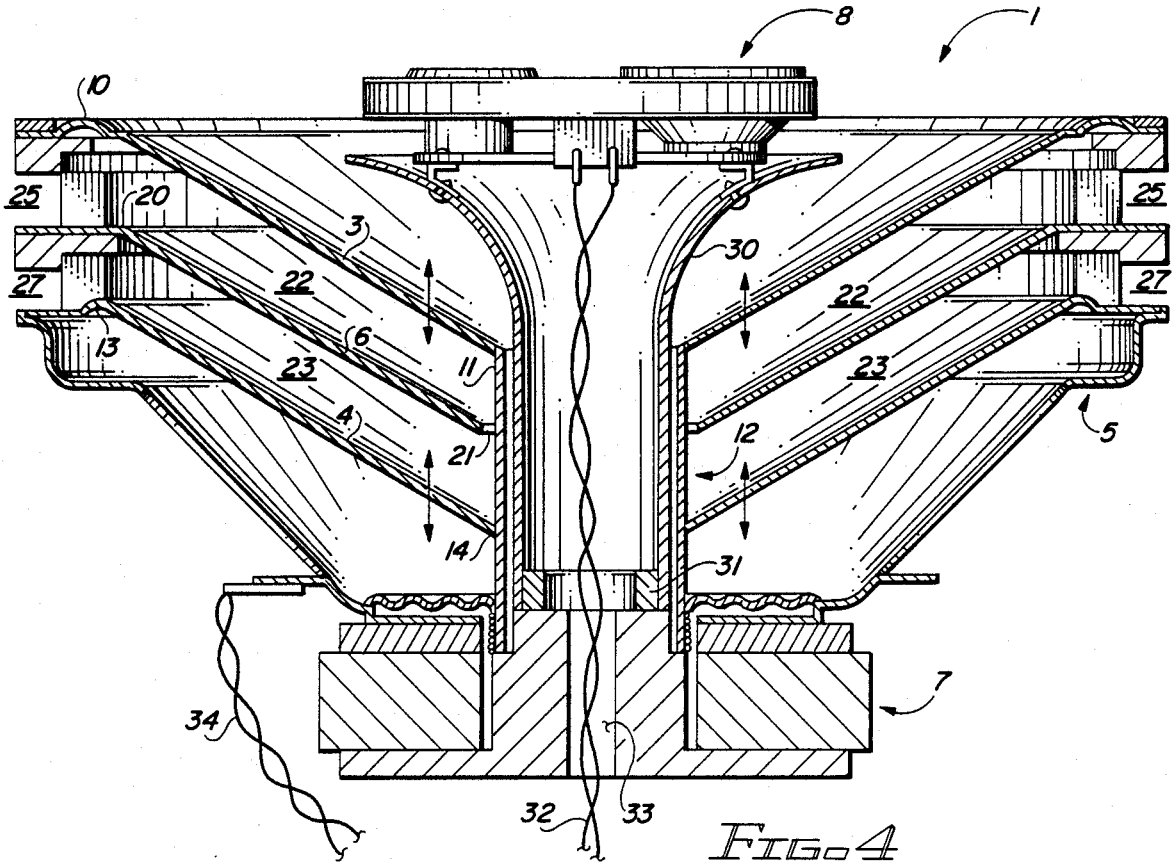
FIG. 4 is a cross section taken along the lines 4—4 of FIG. 1 and showing the internal structure of the exemplary embodiment.

Consider now the detailed cross sectional view of FIG. 4 and the enlarged fragmentary view of FIG. 5. The first or upper speaker diaphragm 3 has an outer periphery 10 (which is flexibly supported from the frame 5) and an inner periphery 11 which is attached to an upper section 18 of a voice coil form 12. That is, a central opening provided in the upper speaker diaphragm 3 defines an inner periphery which is physically fixed to the cylindrical voice coil form 12 for coaxial movement therewith. Similarly, the second or lower speaker diaphragm 4 has an outer periphery 13 which is flexibly supported on the frame 5 and a central opening defining an inner periphery 14 which is attached to the cylindrical voice coil form for coaxial movement with the form and in unison with the movement of the inner periphery of the first speaker diaphragm 3.

The magnet structure 7 includes a centrally positioned, circular air gap 16 into which a first section 17 of the cylindrical voice coil form 12 extends; the second section 18 of the voice coil form 12 being disposed outside the air gap 16 and being coupled with the speaker diaphragms 3, 4 at their inner peripheries 11, 14 as previously described.

The intermediate baffle 6 is suspended at its outer periphery 20 from the frame 5 and extends inwardly generally parallel to the speaker diaphragms 3, 4 to a central opening defining an inner periphery 21. The inner periphery 21 of the baffle 6 is slightly spaced from the outer surface of the second section 18 of the voice coil form 12 in order that it will not interfere with the axial translation of the form. Preferably, the separation between the inner periphery 21 of the intermediate baffle 6 and the outer wall of the voice coil form 12 is minimized to the extent that it can be safely done in order to define an upper chamber 22 between the lower face of the upper speaker diaphragm 3 and the upper face of the intermediate baffle 6 and also to define a lower chamber 23 between the lower face of the intermediate baffle 6 and the upper face of the lower speaker diaphragm 4.

Referring again to FIGS. 1, 2 and 3 as well as to FIG. 4, the upper chamber 22 and the lower chamber 23 are separately, and, preferably differently, vented to the ambient atmosphere. In the exemplary elliptical embodiment of the subject speaker transducer assembly, there is more or less defined two narrow ends and two broad sides. The outlet 25 from the first vent system for the upper chamber 22 is situated across at least one, and preferably both, narrow ends of the speaker assembly in the region of the outer peripheries of the first speaker diaphragm 3 and the intermediate baffle 6. (For convenience, this position is described as being "at" the peripheries.) Similarly, at least a first portion of the outlet 26 of the second vent system for the lower chamber 22 is situated along at least one, and preferably both, the broad sides of the outer peripheries of the second speaker diaphragm and the intermediate baffle 6. However, it has been found to be desirable to provide a substantially greater cross sectional outlet area for the second vent system than the cross sectional outlet area of the first vent system. Therefore, optionally, a second portion 27 of the second vent system may also be provided across at least one of, and preferably both, the narrow ends of the outer peripheries of the second speaker diaphragm 4 and the intermediate baffle 6. Thus, in this configuration, the outlet of the second vent system is distributed among both broad sides and both narrow ends in the region of the outer peripheries of the second speaker diaphragm and intermediate baffle 6. The functional result of providing different outlet cross sectional areas for the vent systems of the upper chamber 22 and the lower chamber 23 is to differently load (sometimes called "stiffness") the speaker diaphragms 3 and 6. This feature results in a slight stagger tuning at the lower frequencies in order that the load on each of the speaker diaphragms 3, 4 is slightly less resulting in a smoother low frequency response with less distortion at intense power levels.

Referring again to FIGS. 4 and 5, the overall frequency response of the speaker assembly 1 may be somewhat smoothed if the pressure waves emanating from the top surface of the first speaker diaphragm 3 are guided outwardly away from the under surface of the supplementary speaker transducer subsystem 8. This may be achieved by the employment of an optional support for the supplementary speaker transducer subsystem 8 which includes the outwardly flared upper baffle 30 positioned between the first speaker diaphragm 3 and the supplementary speaker transducer system 8. The upper baffle 30 extends from a small end situated coaxially with respect to and within the cylindrical voice coil form 12 and flares outwardly to a large end terminating proximate and beneath the supplementary speaker transducer subsystem 8. Preferably, the lower end of the upper baffle 30 is affixed to and supported from the top of the portion of the magnet system 7 residing within the voice coil form 12 where it may be secured in place by adhesive bonding with or without a secondary support piece 31 which serves to further stabilize the upper baffle 30 and to provide additional area for the adhesive employed to adhere to.

Those skilled in the art will understand that the usual means for bringing the speaker leads from a coaxial tweeter/midrange unit to an external amplifier is by physically passing them through the diaphragm of the lower frequency transducer. This has long been recognized as potentially deleterious to the performance of the latter. In the present speaker system, this condition is avoided by bringing the leads 32 downwardly through the interior of the upper baffle 30 and through a central aperture 33 provided through the magnet system 7 such that the leads 32 may be connected in parallel with the leads 34 which connect the voice coil 35 wound circumferentially onto the first section 17 of the voice coil form 12 to an external amplifier. In this configuration, the supplementary speaker transducer system 8 typically carries a cross over network (not shown) to avoid applying low frequency signals to its transducer(s). Alternatively, in bi-amplified reproduction systems, the two pairs of leads 32, 34 may be connected externally to their separate amplifiers in the well-known fashion.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. A speaker transducer assembly comprising:

(A) a magnet system having a circular air gap;

(B) a cylindrical voice coil form having a first section hereof extending into said air gap and a second section disposed outside said air gap;

(C) a voice coil wound circumferentially onto said first section of said voice coil form;

(D) first and second speaker diaphragms;

(E) frame means supporting said first and second speaker diaphragms in over and under juxtaposition and coaxially aligned with one another and with said cylindrical form;

(F) said first speaker diaphragm having an outer periphery and a central opening defining an inner periphery, said inner periphery of said first speaker diaphragm being attached to said second section of said cylindrical voice coil form for coaxial movement therewith;

(G) said second speaker diaphragm having an outer periphery and a central opening defining an inner periphery, said inner periphery of said second speaker diaphragm being attached to said second section of said cylindrical voice coil form for coaxial movement therewith and in unison with said inner periphery of said first speaker diaphragm; and (H) an intermediate baffle coaxially positioned between said first and second speaker diaphragms, said intermediate baffle having an outer periphery rigidly supported by said frame and a central opening defining an inner periphery terminating in such a manner that the inner periphery of said baffle is slightly spaced from said second section of said cylindrical voice coil form.

2. The speaker transducer assembly of claim 1 in which:

(A) said first speaker diaphragm said intermediate and baffle define and upper chamber; and (B) said second speaker diaphragm and said intermediate baffle define a lower chamber; and in which:

(C) said upper chamber is vented through a first vent system having an outlet situated in the region of said outer peripheries of said first speaker diaphragm and said intermediate baffle; and (D) said lower chamber is vented through a second vent system having an outlet situated in the region of said outer peripheries of said second speaker diaphragm and said intermediate baffle.

3. The speaker transducer assembly of claim 2 in which said first and second vent systems have different cross sectional outlet areas.

4. The speaker transducer assembly of claim 3 in which the cross sectional outlet area of said second vent system is greater than the cross sectional outlet area of said first vent system.

5. The speaker transducer assembly of claim 4 in which:

(A) said outer periphery of each of said first and second speaker diaphragms and said intermediate baffle are generally elliptically shaped, having two narrow ends and two broad sides; and in which:

(B) said outlet of said first vent system is situated across at least one of said narrow ends of said outer peripheries of said first speaker diaphragm and said intermediate baffle; and (C) at least a first portion of said outlet of said second vent system is situated along at least one of said broad sides of said outer peripheries of said second speaker diaphragm and said intermediate baffle.

6. The speaker transducer assembly of claim 5 in which a second portion of said outlet of said second vent system is situated across at least one of said narrow ends of said outer peripheries of said second speaker diaphragm and said intermediate baffle.

7. The speaker transducer assembly of claim 6 in which:

(A) said outlet of said first vent system is distributed between both narrow ends of said outer peripheries of said first speaker diaphragm and said intermediate baffle; and (B) said outlet of said second vent system is distributed among both broad sides and both narrow ends of said outer peripheries of said second speaker diaphragm and said intermediate baffle.

8. The speaker transducer assembly of claim 1 which further includes:

(A) a supplementary speaker transducer subsystem having at least a third speaker diaphragm, said supplementary speaker transducer subsystem being positioned generally centrally of said frame and spaced from said first speaker diaphragm; and (B) a central aperture through said magnet system for accommodating speaker leads for energizing said supplementary speaker transducer subsystem from an external amplifier.

9. The speaker transducer assembly of claim 8 which further includes an outwardly flared upper baffle positioned between said first speaker diaphragm and said supplementary speaker transducer subsystem, said upper baffle extending from a small end situated coaxially with respect to and within said cylindrical voice coil form to flare outwardly to a large end terminating proximate said supplementary speaker transducer subsystem.

10. The speaker transducer assembly of claim 9 in which said small end of said upper baffle is fixed to and supported by said magnet system.

* * * * *